US009394152B2

(12) United States Patent
Connellan et al.

(10) Patent No.: US 9,394,152 B2
(45) Date of Patent: Jul. 19, 2016

(54) PILL TRAY SPATULA

(71) Applicant: David L. Doretti, Scottsdale, AZ (US)

(72) Inventors: James A. Connellan, Boca Raton, FL (US); William D. Moyer, Elgin, IL (US); Ryan Hamblin, Apache Junction, AZ (US)

( * ) Notice: Subject to any disclaimer, the term of this patent is extended or adjusted under 35 U.S.C. 154(b) by 321 days.

(21) Appl. No.: 14/267,854

(22) Filed: May 1, 2014

(65) Prior Publication Data

US 2014/0237730 A1 Aug. 28, 2014

Related U.S. Application Data

(63) Continuation-in-part of application No. 13/468,445, filed on May 10, 2012, now Pat. No. 8,770,400.

(51) Int. Cl.

| | |
|---|---|
| ***B67B 7/44*** | (2006.01) |
| ***A61J 7/02*** | (2006.01) |
| ***B67B 7/16*** | (2006.01) |
| ***B67B 7/46*** | (2006.01) |

(52) U.S. Cl.

CPC ... *B67B 7/44* (2013.01); *A61J 7/02* (2013.01); *B67B 7/16* (2013.01); *B67B 7/30* (2013.01); *A61J 2205/30* (2013.01)

(58) Field of Classification Search

CPC ..... B67B 7/16; B67B 7/30; B67B 7/44; A61J 7/02

See application file for complete search history.

(56) References Cited

U.S. PATENT DOCUMENTS 3,255,894 A * 6/1966 Van Handel ..... A61J 7/02 222/502

6,598,297 B1 * 7/2003 Matt ..... B26B 11/00 30/142

(Continued)

OTHER PUBLICATIONS artpromos.com, "Pill Counting Tray", http://www.artpromos.com/detail.asp?id=1184[Jun. 9, 2011 3:34:36 PM]; Printed directly on plastic.

(Continued)

*Primary Examiner* — David B Thomas

(74) *Attorney, Agent, or Firm* — Keith L. Jenkins Registered Patent Attorney, LLC; Keith L. Jenkins

(57) ABSTRACT

A pharmacist's spatula, or pill tray spatula, is provided for assisting in sorting and counting of pills and capsules comprising generally flat stainless steel blades extending from opposing ends of a generally bi-conic handle. The first blade has a straight portion less than or equal in length to a width or length of a pill counting tray, a curved portion between the straight portion and the handle and a curved and angled tip at the distal end of the first edge of the first blade. The second edge of the first blade has a notched hook, a fulcrum, and a bottle opener. The second blade is short and has the shape of a flat truncated arrow.

20 Claims, 9 Drawing Sheets

(56) References Cited

U.S. PATENT DOCUMENTS

| | | | | |
|---|---|---|---|---|
| 8,066,124 | B2 | 11/2011 | Koh | |
| 8,530,763 | B2 * | 9/2013 | Bradley | G01G 17/00 177/25.17 |
| 8,770,400 | B2 * | 7/2014 | Connellan | A61J 7/02 206/223 |
| 2003/0110572 | A1 * | 6/2003 | Percival | A47G 21/065 7/151 |
| 2012/0031815 | A1 * | 2/2012 | Walter | B07B 13/00 209/45 |

OTHER PUBLICATIONS

Amazon>Com, Grafco Pill Counter Health & Personal Care, http://www.amazon.com/Graham-Field-Grafco-Pill-Counter/dp/B000NNHSTA[Jun. 9, 2011 3:26:15 PM].

Quality Logo Products, "Safe'n Easy Pill Counter Tray | Trade Show Giveaways", http://www.qualitylogoproducts.com/tradeshow-promotions/safen-easy-pill-counter-tray.htm[Jun. 9, 2011 3:36:34 PM].

Alibaba.com. "729006 Pill Counting Tray Sales", http://www.alibaba.com/product-gs/362922342/729006_PILL_COUNTING_TRAY/showimage.html[Jun. 9, 2011 3:30:38 PM].

* cited by examiner

PILL TRAY SPATULA

RELATED APPLICATIONS

This application is a continuation in part of U.S. patent application Ser. No. 13/468,445 filed May 10, 2012 to the same inventor.

TECHNICAL FIELD

The present invention generally relates to spatulas for pharmaceutical use, and more particularly relates to an apparatus for assisting in sorting pills and capsules, opening bottles and other pharmaceutical containers.

BACKGROUND

Pharmacist's spatulas, or pill tray spatulas, are used to count pills on pill trays. In the process of pill counting, pill containers must first be opened. The openings of such containers are typically tightly sealed for security and safety reasons, and can be difficult to open by hand in a quick and efficient manner.

Accordingly, it is desirable to provide a single tool for both opening pill containers and for sorting and counting pills. Furthermore, other desirable features and characteristics of the present invention will become apparent from the subsequent detailed description, taken in conjunction with the accompanying drawings and the foregoing technical field and background.

BRIEF SUMMARY OF THE INVENTION

A pharmacist's spatula is provided for assisting in sorting and counting of pills and capsules comprising generally flat stainless steel blades extending from opposing ends of a generally bi-conic handle. The first blade has a straight portion that is less than a width or length of a pill counting tray, a curved portion between the straight portion and the handle and a curved and angled tip at the distal end of the first edge of the first blade. The second edge of the first blade has a notched hook, a straight portion, a fulcrum, and a bottle opener. The second blade is short and has the shape of a flat truncated arrow.

An embodiment of the invention provides a pharmacist's spatula including: a handle having a first end, a second end, and a surface extending between the first and second ends; a first elongated flat blade extending from the first end and having a first edge and an opposed second edge; a second shorter flat blade extending from the second end; and a curved tip extending from a distal end of the first blade at an obtuse angle there from. The pharmacist's spatula, in which the handle includes a shape of two truncated cones, joined at their bases, and the joint made axially arcuate. The pharmacist's spatula, in which the second blade is in the shape of a flat truncated arrow. The pharmacist's spatula, in which the curved tip is curved conformally to a curvature between a pill-supporting surface and a rear wall of a pill counting tray. The pharmacist's spatula, in which the first edge has a straight portion having a length less than a width or a length of a pill-supporting surface of a pill counting tray. The pharmacist's spatula, in which the first edge has a curved portion proximal the first end of the handle, in which the curved portion has a curvature conformal with a curvature between a pill-supporting surface and a front wall of a pill counting tray. The pharmacist's spatula, further including a bottle opener formed in the second edge. The pharmacist's spatula, further including a hook extending from the distal end of the first blade. The pharmacist's spatula, further including a notch in the hook. The pharmacist's spatula, in which the first blade is made of stainless steel. The pharmacist's spatula, in which the second blade is made of stainless steel.

Another embodiment of the invention provides a pharmacist's spatula including: a handle having a first end, a second end, and a surface extending between the first and second ends; a first elongated flat blade extending from the first end and having a first edge and an opposed second edge; a second shorter flat blade extending from the second end; and a curved tip extending from a distal end of the first blade at an obtuse angle there from, in which the curved tip is curved conformally to a curvature between a pill-supporting surface and a rear wall of a pill counting tray. The pharmacist's spatula, in which the handle includes a shape of two truncated cones, joined at their bases, and the joint made axially arcuate. The pharmacist's spatula, in which the second blade is in the shape of a flat truncated arrow. The pharmacist's spatula, in which the first edge includes: a curved portion extending from the handle, in which the curvature is conformal to a curvature between a pill-supporting surface of a pill counting tray and a front wall of the tray; and a straight portion, including a length less than a length or a width of a pill counting tray, extending from the curved portion and ending at the curved tip. The pharmacist's spatula, in which the second edge includes: a hook extending from the distal end of the first blade; a straight portion extending toward the handle from a bend of the hook; a fulcrum extending as a smoothed triangular extension from the straight portion; a bottle opener, spaced apart from the fulcrum across a bight for receiving edges of bottle caps to be lifted, and extending to the handle. The pharmacist's spatula, in which the first and second blades comprise stainless steel.

Another embodiment of the invention provides a pharmacist's spatula including: a handle having a first end, a second end, and a surface of extending between the first and second ends, in which the handle includes a shape of two truncated cones, joined at their bases, and the joint made axially arcuate; a first elongated flat blade extending from the first end and having a first edge and an opposed second edge; a second shorter flat blade extending from the second end; and a curved tip extending from a distal end of the first blade at an obtuse angle there from, in which the curved tip is curved conformally to a curvature between a pill-supporting surface and a rear wall of a pill counting tray. The pharmacist's spatula, in which the first edge includes: a curved portion extending from the handle, in which the curvature is conformal to a curvature between a pill-supporting surface of a pill counting tray and a front wall of the tray; and a straight portion, including a length less than a length or a width of a pill counting tray, extending from the curved portion and ending at the curved tip. The pharmacist's spatula, in which the second edge includes: a hook extending from the distal end of the first blade; a straight portion extending toward the handle from a bend of the hook; a fulcrum extending as a smoothed triangular extension from the straight portion; a bottle opener, spaced apart from the fulcrum across a recess for receiving edges of bottle caps to be lifted, and extending to the handle.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Figure 1:
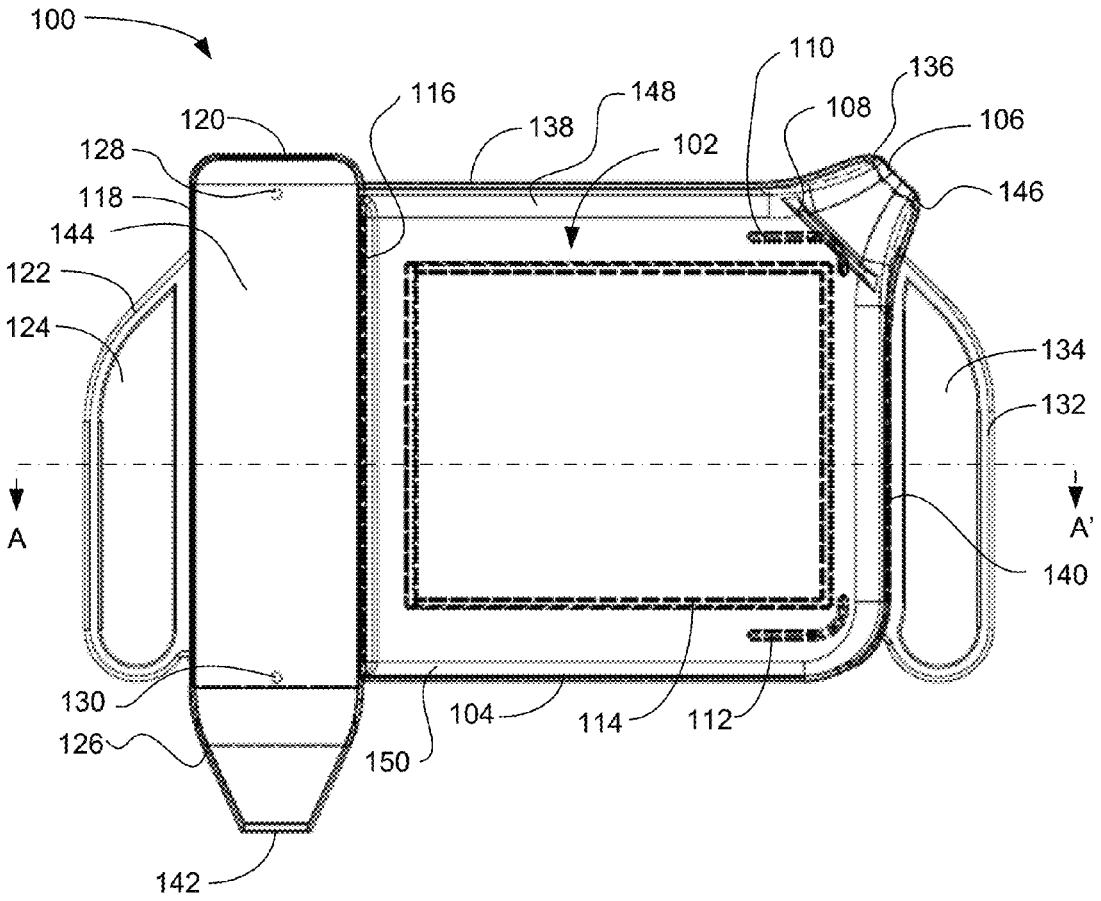
FIG. 1 is a top plan wire frame view illustrating an exemplary pill tray and defining a cross-section AA', according to a preferred embodiment of the present invention.

FIG. 1 is a top plan wire frame view illustrating an exemplary pill tray 100 and defining a cross-section AA', according to a preferred embodiment of the present invention. The pill-supporting surface 102 of tray 100 arcuately merges with a rear wall 138, a front wall 104, and a side wall 140 with the directions referenced to FIG. 1 with rear at the top of the drawing. Pill receiver 144 lies along the left edge of the surface 102 and is separated from the surface 102 by a sloping ridge 116 that has no flat surfaces. Flat surfaces on the ridge 116 or between pill-supporting surface 102 and pill receiver 144 are preferably avoided to avoid pill dust accumulation on such flat surfaces. Rear wall 138, side wall 140, and front wall 104 curve upward from surface 102 with predetermined curvatures 148 (back and side) and 150 (front), respectively.

Pill receiver 144 has a front funnel portion 126 with a funnel opening 142 for pouring counted pills in the pill receiver 144 into dispensing pill bottles. The external side of pill receiver 144 supports a handle 124, preferably with a raised perimeter 122. Pill receiver 144 is shown without a closable lid. In some alternate embodiments, a closable lid may be provided. In such an alternate embodiment, the edge of the lid that meets the ridge 116 will be shaped conformally to the curvature of the ridge 116. The rear wall 120 of pill receiver 144 extends rearward of the rear wall 138 to the same extent as rearmost extension 136 of return funnel 106, in order that the pill tray 100 will sit flush against a wall behind a counter upon which the pill tray 100 has been placed.

Handle 134 extends from the right wall 140 and preferably includes a raised perimeter 132. Preferably, the length dimension extension of the right handle 134 rightward of the rightmost extent 146 of return funnel 106 added to the length dimension of the leftmost extension of the left handle 124 from the pill receiver 144 is no greater that the leftward extent of an open lid, or cover, for the pill receiver 144, as shown. Accordingly, the pill tray 100 takes up no greater footprint on a counter top than a prior art device of the same pill-supporting surface 102 size with its cover open. That is, the operating footprint of the pill tray 100 on a countertop is not increased relative to equivalent-capacity prior art devices. While the left and right extents of the handles 124 and 134, respectively, are limitations of this exemplary embodiment of the pill tray 100, the handle shape shown is not a limitation. It is within the scope of the present invention to have the surfaces of the handles 124 and 134 be suitable for displaying advertising. In some alternate embodiments, the left and right extensions of the handles may increase the operating footprint of the pill tray 100.

The underside of pill receiver 144 has a front foot 130 and a rear foot 128. The underside of tray 100 has advertising sleeve 114 and front tray foot 112 and rear tray foot 110. Advertising sleeve 114 receives advertising media, such as printed media, that displays advertising to the user through transparent pill-supporting tray surface 102. The media is preferably received in a slot 602 (see FIG. 6) between front tray foot 112 and rear tray foot 110. Note that the horizontally curved portions of front tray foot 112 and rear tray foot 110 do not obstruct access to slot 602. Advertising sleeve 114 may be of various sizes, and is preferably at least large enough to receive a conventional business card. Tray surface 102 is preferably entirely transparent, however, in various alternate embodiments, tray surface 102 may be transparent only over the advertising sleeve or made of colored transparent material.

Return funnel 106 extends from rear wall 138 and right wall 140 and has a return ridge 108 to prevent inadvertent pill migration out of the return funnel 106. Rear wall 138 extends downwardly to one side of return funnel 106 and side wall 140 first extends in height (See ref. 502 in FIG. 5) and then extends downwardly in height to form return funnel 106.

Figure 2:
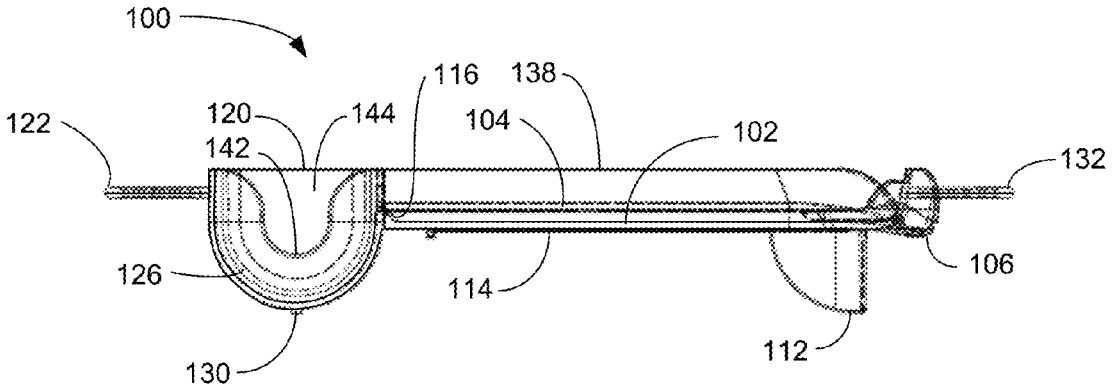
FIG. 2 is a front elevation wire frame view illustrating the exemplary pill tray of FIG. 1, according to a preferred embodiment of the present invention.

FIG. 2 is a front elevation wire frame view illustrating the exemplary pill tray 100 of FIG. 1, according to a preferred embodiment of the present invention. The pill receiver 144 has sufficient depth between the bottom of funnel opening 142 and the bottom of the pill receiver 144 to accommodate a volume of pills sufficient to fill a prescription. Seen with FIG. 1, the vertical edge curvature of front tray foot 112 is apparent and tray foot 110 is preferably formed in mirror image shape to front tray foot 112. The height of rear wall 138 is flush with the height of pill receiver 144 and the height of front wall 104 is flush with the height of the ridge 116. Return funnel 106 is preferably downward sloping, as shown, which reduces the amount that the pill tray 100 must be tilted to return unused pills to a storage or supply container.

Figure 3:
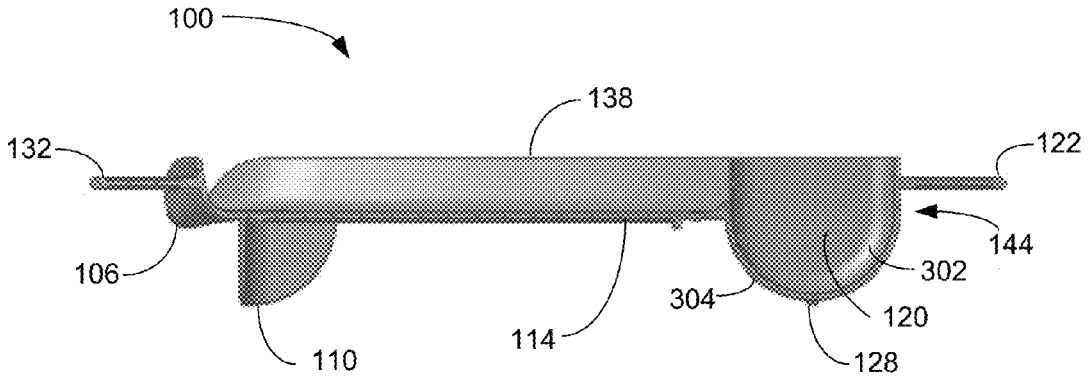
FIG. 3 is a rear shaded view illustrating the exemplary pill tray of FIG. 1, according to a preferred embodiment of the present invention.

FIG. 3 is a rear shaded elevation view illustrating the exemplary pill tray 100 of FIG. 1, according to a preferred embodiment of the present invention. Rear wall 120 of pill receiver 144 preferably has an arcuate lower perimeter 302 extending into the semi cylindrical main trough 304 of pill receiver 144, as shown. The vertical edge curvature and horizontal curvature of rear tray foot 110 can be seen. The design of the rear tray foot 110 and front tray foot 112 avoids the need for a flange extending between the tray feet 110, 112 or from the tray feet 110, 112 to the pill receiver 144.

Figure 4:
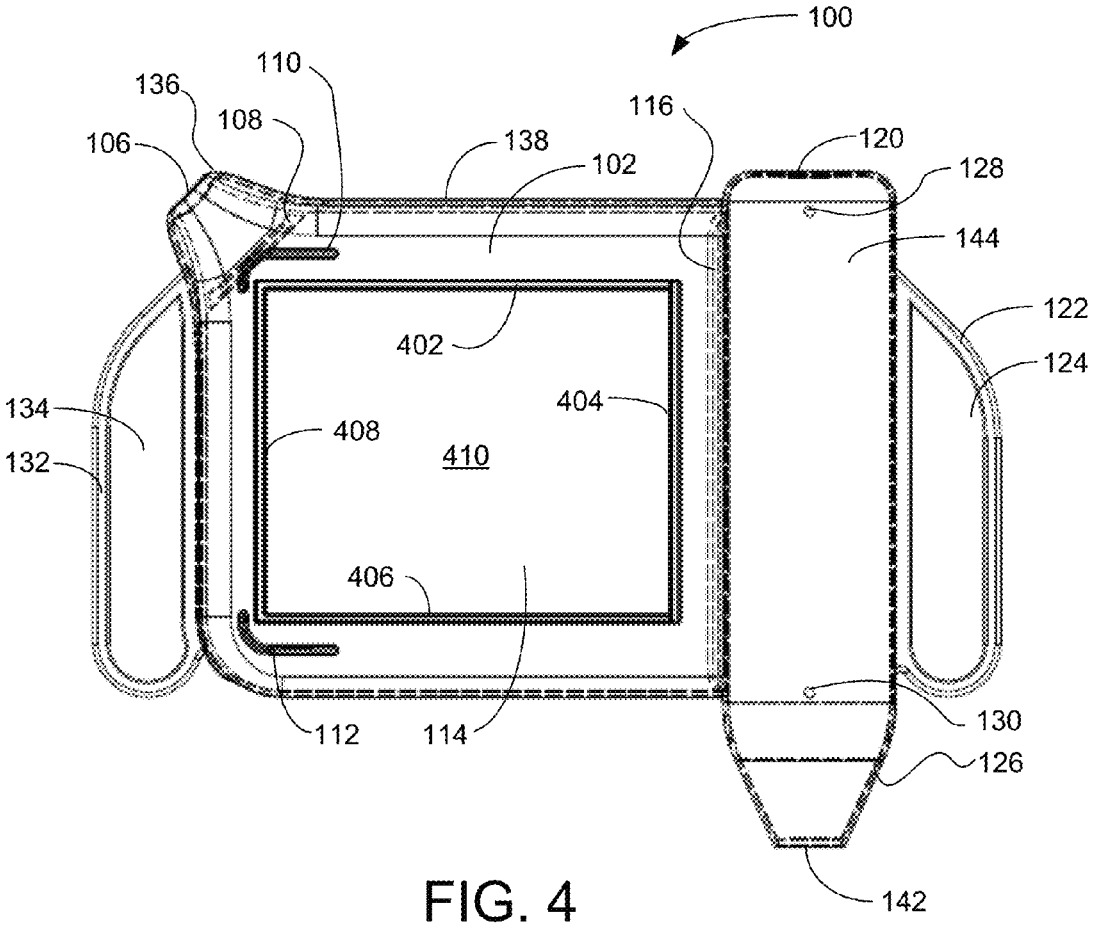
FIG. 4 is a bottom view plan wire frame view illustrating the exemplary pill tray of FIG. 1, according to a preferred embodiment of the present invention.

FIG. 4 is a bottom view plan wire frame view illustrating the exemplary pill tray 100 of FIG. 1, according to a preferred embodiment of the present invention. Advertising sleeve 114 has sides 402, 404, and 406 that extend from the underside of tray surface 102 to advertising sleeve panel 410. Advertising sleeve 114 also has sleeve edge 408 that does not extend to the underside of tray surface 102, but remains open to form slot 602 (see FIG. 6) for receiving advertising media. The advantages of advertising sleeve 114 over the prior art are that the advertising media are replaceable, making the pill tray 100 more fungible; and the print does not contact the medications being counted on the tray surface 102.

Figure 5:
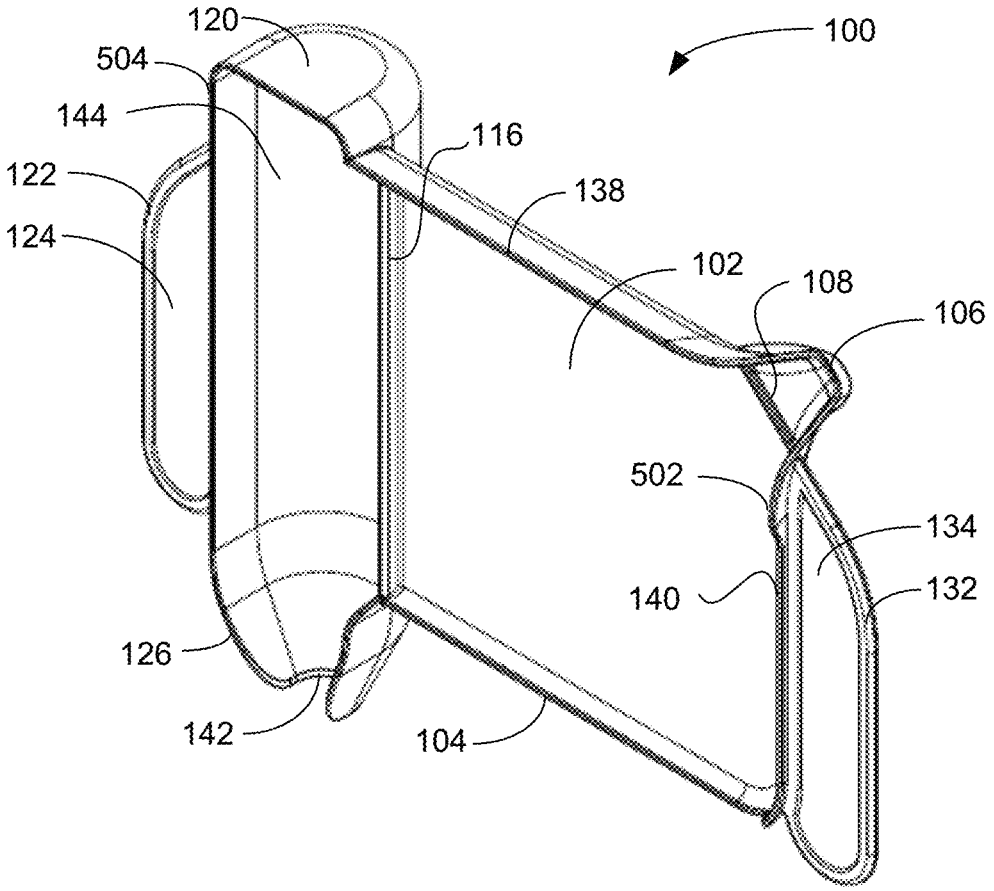
FIG. 5 is a top-right perspective wire frame view illustrating the exemplary pill tray of FIG. 1, according to a preferred embodiment of the present invention.

FIG. 5 is a top-right perspective wire frame view illustrating the exemplary pill tray 100 of FIG. 1, according to a preferred embodiment of the present invention. Side wall 140 is higher than front wall 104, and side wall 140 extends further to an increased height 502 before extending downward and outward to form return funnel 106. While the rear wall 138, front wall 104, and side wall 140 are shown as primarily straight and of even height, such features are exemplary rather than limiting. The top edge 504 of pill receiver 144 is similarly not limited to be straight or of even height.

Figure 6:
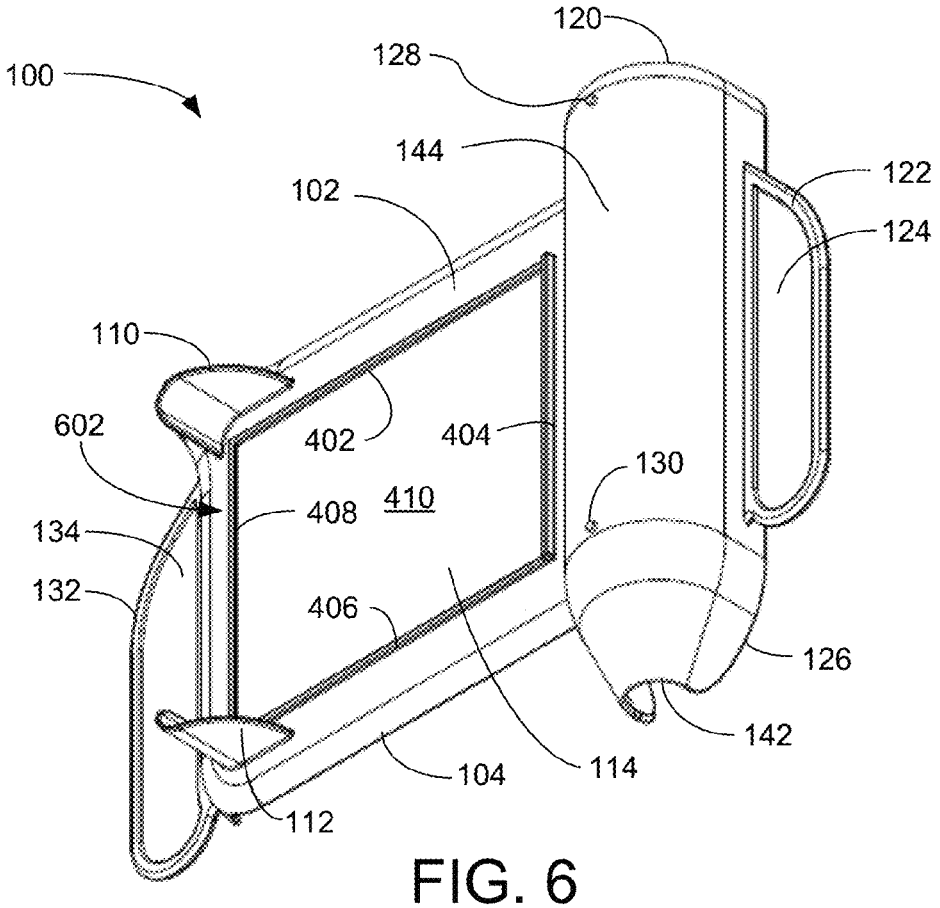
FIG. 6 is a bottom-left-front perspective wire frame view illustrating the exemplary pill tray of FIG. 1, according to a preferred embodiment of the present invention.

FIG. 6 is a bottom-left-front perspective wire frame view illustrating the exemplary pill tray 100 of FIG. 1, according to a preferred embodiment of the present invention. Slot 602 under edge 408 of advertising sleeve 114 is operable to slidingly receive printed advertising media. Front foot 130 and a rear foot 128 provide additional stability over prior art devices, in which minor irregularities in the manufacture of the pill receiver 144 can cause unexpected tilting during operation. The inner curvature of rear tray foot 110 is visible.

Figure 7:
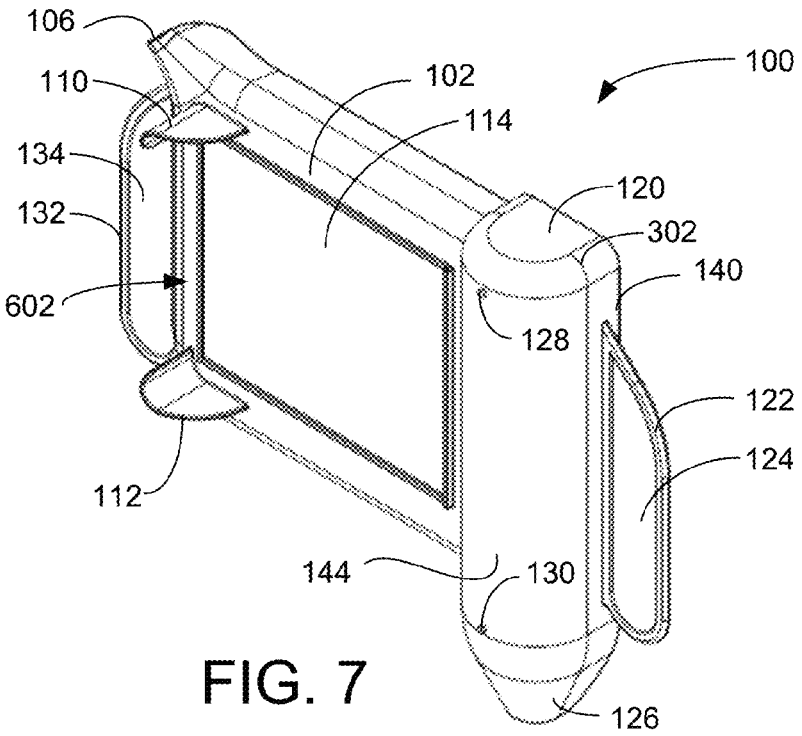
FIG. 7 is a bottom-left-rear perspective wire frame view illustrating the exemplary pill tray of FIG. 1, according to a preferred embodiment of the present invention.

FIG. 7 is a bottom-left-rear perspective wire frame view illustrating the exemplary pill tray 100 of FIG. 1, according to a preferred embodiment of the present invention. The inner curvature of front tray foot 112 is visible.

Figure 8:
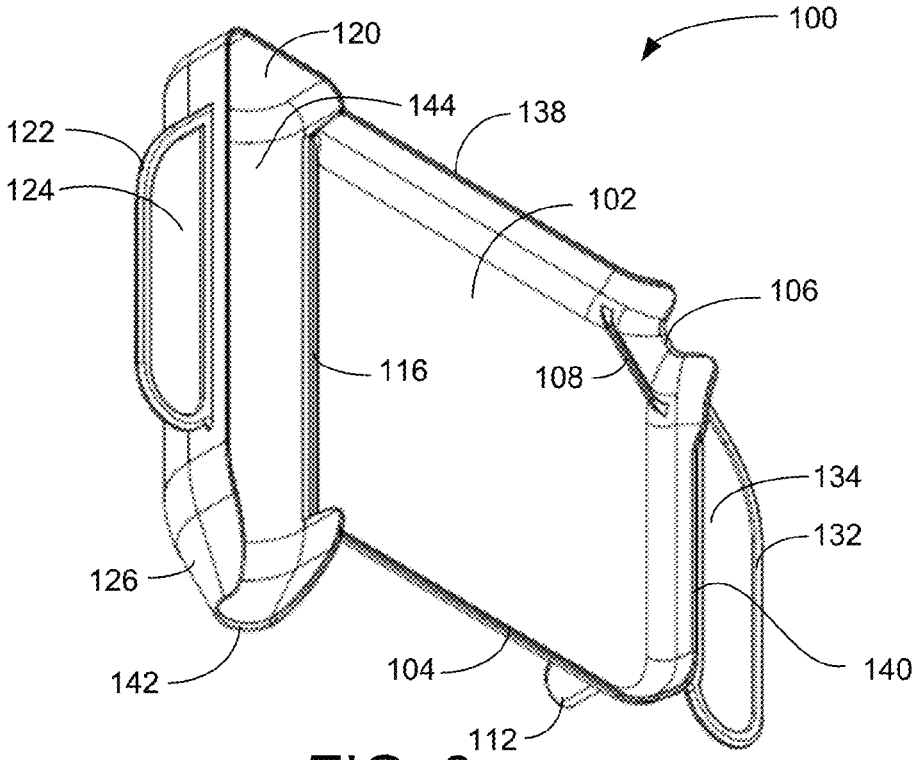
FIG. 8 is a top-left-front perspective wire frame view illustrating the exemplary pill tray of FIG. 1, according to a preferred embodiment of the present invention.

FIG. 8 is a top-left-front perspective wire frame view illustrating the exemplary pill tray 100 of FIG. 1, according to a preferred embodiment of the present invention. Return ridge 108 is best displayed in this view. Return ridge 108 assists in preventing pills from exiting the tray during counting operations, but is not so high as to prevent pills from exiting when the pill tray 100 is tilted to return unused pills to the supply container. Like ridge 116, return ridge 108 is rounded and has no flat surfaces. The entire pill tray 100 is preferably made as one piece of injection molded plastic, including return ridge 108.

Figure 9:
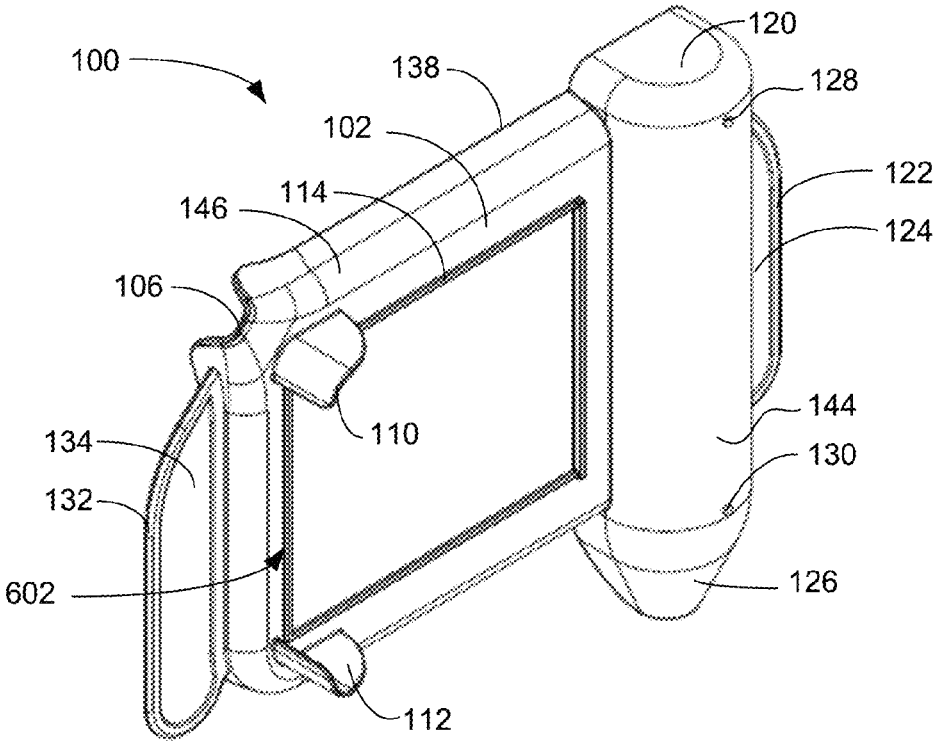
FIG. 9 is a bottom-right-rear perspective wire frame view illustrating the exemplary pill tray of FIG. 1, according to a preferred embodiment of the present invention.

FIG. 9 is a bottom-right-rear perspective wire frame view illustrating the exemplary pill tray 100 of FIG. 1, according to a preferred embodiment of the present invention. Slot 602 may be clearly seen in this view. Extending tray surface 102 into rear wall 138 is a predetermined curvature 146, which reduces pill dust accumulation.

Figure 10:
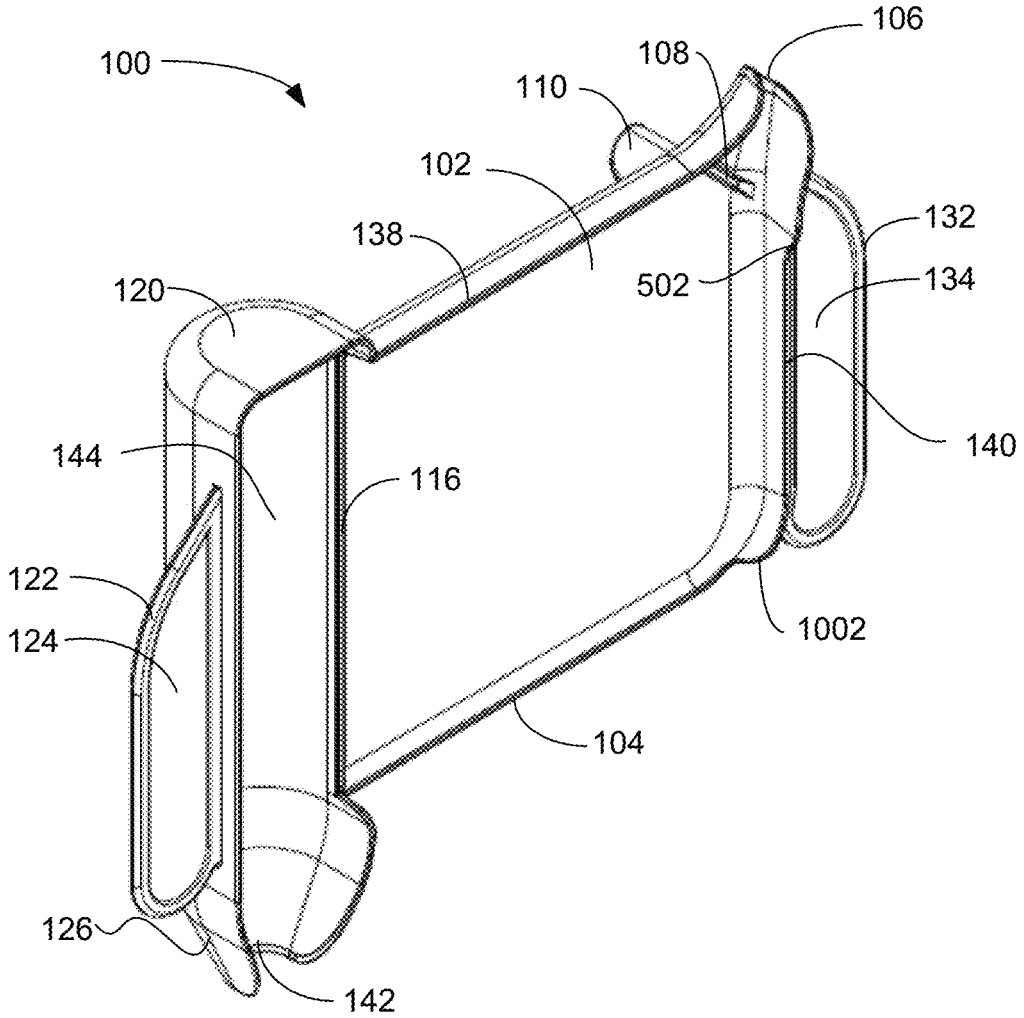
FIG. 10 is a front-left-rear perspective wire frame view illustrating the exemplary pill tray of FIG. 1, according to a preferred embodiment of the present invention.

FIG. 10 is a front-left-rear perspective wire frame view illustrating the exemplary pill tray 100 of FIG. 1, according to a preferred embodiment of the present invention. The corner between front wall 104 and side wall 140 is curved, as shown, and extension 1002 from the height of the front wall 104 to the height of side wall 140 is achieved in the curved corner.

Figure 11:
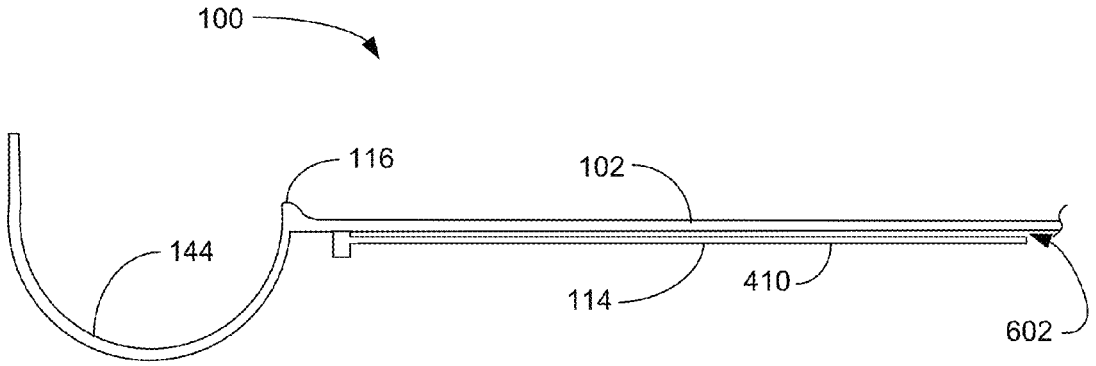
FIG. 11 is a partial cross-sectional view through cross section AA' illustrating details of the exemplary advertising sleeve on the underside of the tray of the exemplary pill tray of FIG. 1, according to a preferred embodiment of the present invention.

FIG. 11 is a partial cross-sectional view through cross section AA' from FIG. 1 illustrating details of the exemplary advertising sleeve 114 on the underside of the tray surface 102 of the exemplary pill tray 100 of FIG. 1, according to a preferred embodiment of the present invention. The curvature of ridge 116 can be seen in this cross section. The slot 602 for receiving advertising media is between tray surface 102 and panel 410 and is preferably sized to receive printed card stock.

Figure 12:
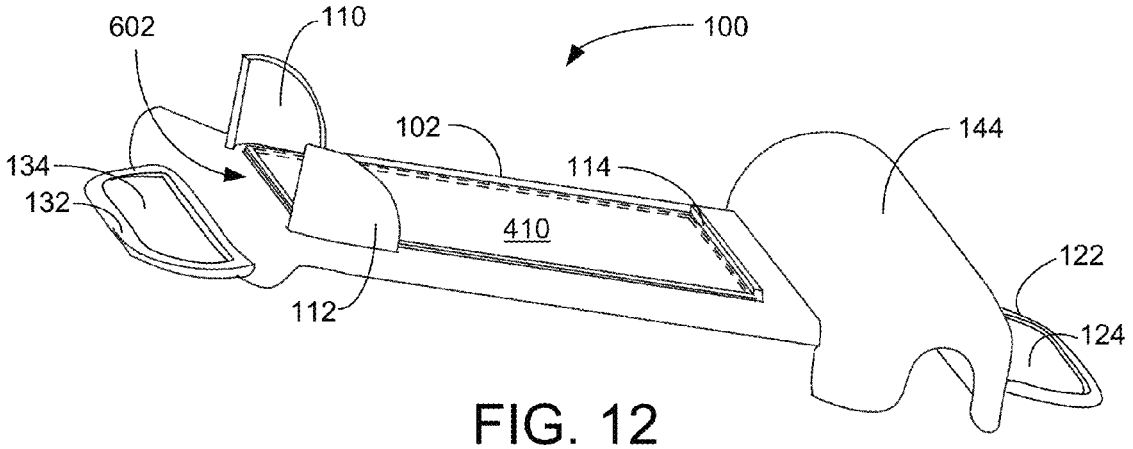
FIG. 12 is a bottom-right-front perspective view AA' illustrating details of the exemplary advertising sleeve on the underside of the tray of the exemplary pill tray of FIG. 1, according to a preferred embodiment of the present invention.

FIG. 12 is a bottom-right-front perspective view AA' illustrating details of the exemplary advertising sleeve 114 on the underside of the tray surface 102 of the exemplary pill tray 100 of FIG. 1, according to a preferred embodiment of the present invention. The access to slot 602 is between front tray leg 112 and rear tray leg 110. In some alternate embodiments access may be changed by providing a front or rear slot 602, with appropriate changes to the front tray leg 112 and rear tray leg 110. A slot 602 proximate the pill receiver 144 is possible, but not required. The alignment of the advertising sleeve 114 with the sides of the tray surface 102 is merely exemplary: other orientations and shapes of advertising sleeve 114 are possible in various alternate embodiments.

Figure 13:
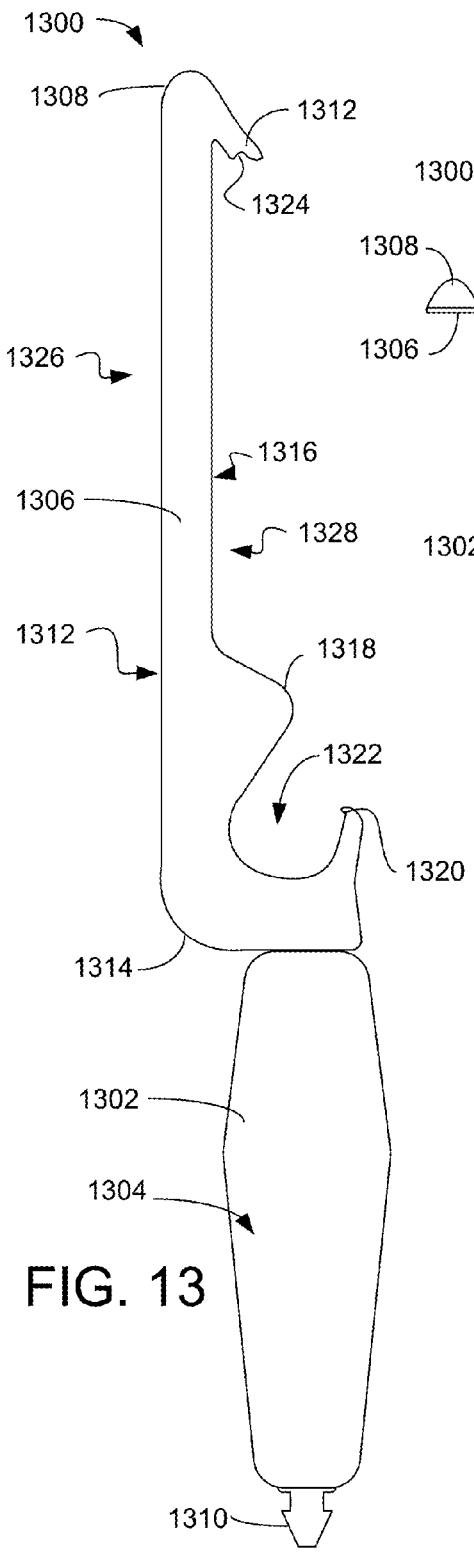
FIG. 13 is a side elevation view illustrating a first exemplary spatula for use with the exemplary pill tray of FIG. 1, according to a preferred embodiment of the present invention.

FIG. 13 is a side elevation view illustrating a first exemplary spatula 1300 for use with the exemplary pill tray 100 of FIG. 1, according to a preferred embodiment of the present invention. Spatula 1300 is preferably sold in a kit 1700 (see FIG. 17) with pill tray 100. In an additional embodiment spatula 1300 is sold without the kit. Spatula 1300 includes a handle 1302, a first blade 1306 extending from a first end of the handle, and a second blade 1310 extending from a second end of the handle 1302. Handle 1302 may include an inset that is suitable for bearing advertising and is preferably shaped for ease of handling. In this exemplary embodiment, that handle 1302 has a surface of rotation similar to two truncated cones joined at their bases with the joint smoothed in an axially arcuate direction. Handle 1302 has a surface of rotation 1304 that is smooth and easily cleaned.

The first blade 1306 has a first edge 1326 that includes a straight portion 1312, a distal curved tip 1308, and a proximal curved portion 1314. Straight portion 1312 has a length 1404 less than a width or length of the pill-supporting surface 102 of pill counting tray 100. The tip 1308 of the blade 1306 extends from a distal end of the straight portion 1312 and has a curvature that preferably matches the particular curvature 148 between the pill-supporting surface 102 and the back wall 138, and so is preferably shaped to be interoperable with pill tray 100. Curve 1314 extends from the handle 1302 to the straight portion 1312 and also has a curvature that preferably matches the particular curvature 150 between the pill-supporting surface 102 and the front wall 104, and so is preferably further shaped to be interoperable with pill tray 100. The entire length of the first blade 1306 is preferably less than or equal to a width and/or a length of pill tray 100.

The first blade has a second edge 1328 that includes a hook 1312 with a notch 1324, a straight portion 1316, a fulcrum 1318, and a bottle opener 1320. Hook 1312 extends toward the handle 1302 from curved tip 1308. The notch 1324 in hook 1312 improves performance in extracting cotton packing material from pill boxes and is also useful for pulling of safety caps as well. The straight portion 1316 of the second edge 1328 extends from a bend of the hook 1312 toward the handle 1302 to merge into smoothed triangular fulcrum 1318. In various embodiments, the shape of fulcrum 1318 may vary. Bottle opener 1320 is used to pry caps off pill bottles, where the fulcrum 1318 engages the top of the bottle cap and the bottle opener 1320 engages a bottom outside edge of the cap which cap is partially received in the bight 1322.

Second blade, or spear, 1310 is used for initially penetrating hermetic seals on pill supply bottles after the cap has been removed. Second blade 1310 is preferably shaped as a flat truncated arrow. The edges of both blades 1306 and 1310 are preferably not sharpened, but are blunt.

The spatula 1300 preferably has a plastic handle 1302 and a metal blade 1306. The metal is preferably stainless steel. In alternate embodiments, other materials may be used such as, for non-limiting examples, all metal or all plastic. No limit on the materials used to make spatula 1300 is intended, beyond the limitation that the materials must support the function of spatula 100.

Figure 14:
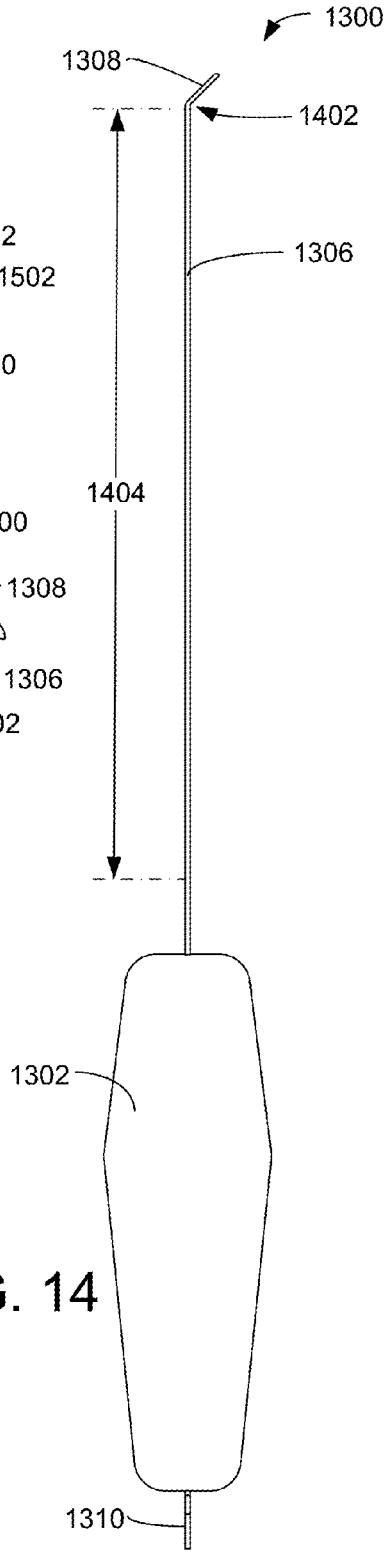
FIG. 14 is a front elevation view illustrating the first exemplary spatula of FIG. 13 for use with the exemplary pill tray of FIG. 1, according to a preferred embodiment of the present invention.

FIG. 14 is a front elevation view illustrating the exemplary spatula 1300 of FIG. 13 for use with the exemplary pill tray 100 of FIG. 1, according to a preferred embodiment of the present invention. As can be seen, blade 1306 can be made from flat metal stock or other flat stock. Curved tip 1308 is obtusely angled 1402 relative to first blade 1306.

Figure 15:
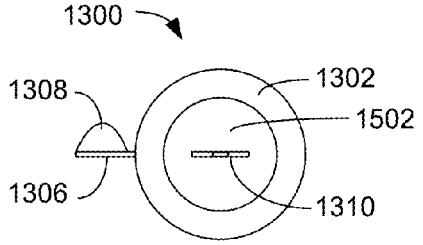
FIG. 15 is a bottom plan view illustrating the first exemplary spatula for use with the exemplary pill tray of FIG. 1, according to a preferred embodiment of the present invention.

FIG. 15 is a bottom plan view illustrating the exemplary spatula 1300 of FIG. 13 for use with the exemplary pill tray 100 of FIG. 1, according to a preferred embodiment of the present invention. The bottom 1502 of handle 1302 is shown with second blade 1310 and a partial view of first blade 1306 with curved and angled tip 1308. The boundary between the bottom 1502 and the handle surface 1304 is shown as sharp for simplicity of illustrations, but is preferably rounded, as shown in FIGS. 13 and 14. The circular cross section for the handle 1302 is merely exemplary, and may be of any ergonomically suitable shape in various embodiments.

Figure 16:
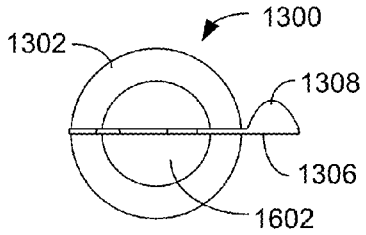
FIG. 16 is a top plan view illustrating the first exemplary spatula for use with the exemplary pill tray of FIG. 1, according to a preferred embodiment of the present invention.

FIG. 16 is a top plan view illustrating the exemplary spatula 1300 of FIG. 13 for use with the exemplary pill tray 100 of FIG. 1, according to a preferred embodiment of the present invention. The top 1602 of handle 1302 is shown with first blade 1306 with curved and angled tip 1308. The boundary between the top 1602 and the handle surface 1304 is shown as sharp for simplicity of illustrations, but is preferably rounded, as shown in FIGS. 13 and 14.

Figure 17:
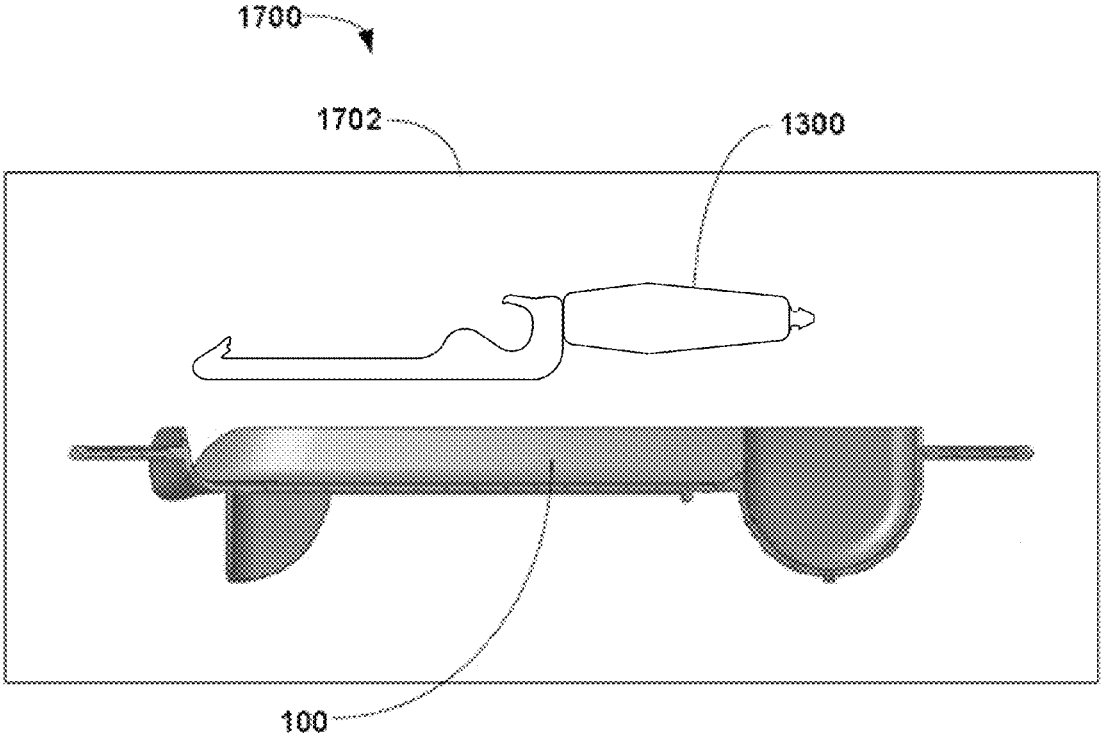
FIG. 17 is a diagrammatic view illustrating an exemplary kit, according to a preferred embodiment of the present invention.

FIG. 17 is a diagrammatic view illustrating an exemplary kit 1700, according to a preferred embodiment of the present invention. Package 1702 may be any type of device for containing or associating spatula 1300 and pill tray 100. Kit 1700 may optionally contain advertising media for insertion in slot 602 of pill tray 100 and may provide such advertising media already within slot 602. Kit 1700 may optionally contain a supply of pills.

Those of skill in the art, enlightened by the present disclosure, will appreciate the methods to adapt the shape of first blade 1306 to various pill tray designs while maintaining the functionality disclosed, all of which adaptations are within the scope of the present invention. For example, for a smaller pill tray, the length 1404 of the straight portion 1312 of the first edge 1326 of the first blade 1306 may be reduced. Likewise, the curved tip 1308 and curved first edge portion 1314 may be shape adapted to various junctions between the pill-supporting surface 102 and the tray walls 138 and 104.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description and the claims below will provide those skilled in the art with a convenient road map for implementing the exemplary embodiment or exemplary embodiments. It should be understood that various changes can be made in the arrangement of elements without departing from the scope of the invention.

We claim:

1. A pharmacist's spatula comprising:

a. a handle having a first end, a second end, and a surface extending between said first and second ends;

b. a first elongated flat blade extending from said first end and having a first edge and an opposed second edge;

c. a second shorter flat blade extending from said second end; and d. a curved tip extending from a distal end of said first blade at an obtuse angle there from.

2. The pharmacist's spatula of claim 1, wherein said handle comprises a shape of two truncated cones, joined at their bases, and said joint made axially arcuate.

3. The pharmacist's spatula of claim 1, wherein said second blade is in the shape of a flat truncated arrow.

4. The pharmacist's spatula of claim 1, wherein said curved tip is curved conformally to a curvature between a pill-supporting surface and a rear wall of a pill counting tray.

5. The pharmacist's spatula of claim 1, wherein said first edge has a straight portion having a length less than one of a width and a length of a pill-supporting surface of a pill counting tray.

6. The pharmacist's spatula of claim 5, further comprising a bottle opener formed in said second edge.

7. The pharmacist's spatula of claim 1, wherein said first edge has a curved portion proximal the first end of said handle, wherein said curved portion has a curvature conformal with a curvature between a pill-supporting surface and a front wall of a pill counting tray.

8. The pharmacist's spatula of claim 1, further comprising a hook extending from said distal end of said first blade.

9. The pharmacist's spatula of claim 8, further comprising a notch in said hook.

10. The pharmacist's spatula of claim 1, wherein said first blade is made of stainless steel.

11. The pharmacist's spatula of claim 1, wherein said second blade is made of stainless steel.

12. A pharmacist's spatula comprising:

a. a handle having a first end, a second end, and a surface extending between said first and second ends;

b. a first elongated flat blade extending from said first end and having a first edge and an opposed second edge;

c. a second shorter flat blade extending from said second end; and d. a curved tip extending from a distal end of said first blade at an obtuse angle there from, wherein said curved tip is curved conformally to a curvature between a pill-supporting surface and a rear wall of a pill counting tray.

13. The pharmacist's spatula of claim 12, wherein said handle comprises a shape of two truncated cones, joined at their bases, and said joint made axially arcuate.

14. The pharmacist's spatula of claim 12, wherein said second blade is in the shape of a flat truncated arrow.

15. The pharmacist's spatula of claim 12, wherein said first edge comprises:

a. a curved portion extending from said handle, wherein said curvature is conformal to a curvature between a pill-supporting surface of a pill counting tray and a front wall of said tray; and b. a straight portion, comprising a length less than one of a length and a width of a pill counting tray, extending from said curved portion and ending at said curved tip.

16. The pharmacist's spatula of claim 12, wherein said second edge comprises:

a. a hook extending from said distal end of said first blade;

b. a straight portion extending toward said handle from a bend of said hook;

c. a fulcrum extending as a smoothed triangular extension from said straight portion;

d. a bottle opener, spaced apart from said fulcrum across a bight for receiving edges of bottle caps to be lifted, and extending to said handle.

17. The pharmacist's spatula of claim 12, wherein said first and second blades comprise stainless steel.

18. A pharmacist's spatula comprising:

a. a handle having a first end, a second end, and a surface of extending between said first and second ends, wherein said handle comprises a shape of two truncated cones, joined at their bases, and said joint made axially arcuate;

b. a first elongated flat blade extending from said first end and having a first edge and an opposed second edge;

c. a second shorter flat blade extending from said second end; and d. a curved tip extending from a distal end of said first blade at an obtuse angle there from, wherein said curved tip is curved conformally to a curvature between a pill-supporting surface and a rear wall of a pill counting tray.

19. The pharmacist's spatula of claim 18, wherein said first edge comprises:

a. a curved portion extending from said handle, wherein said curvature is conformal to a curvature between a pill-supporting surface of a pill counting tray and a front wall of said tray; and b. a straight portion, comprising a length less than one of a length and a width of a pill counting tray, extending from said curved portion and ending at said curved tip.

20. The pharmacist's spatula of claim 18, wherein said second edge comprises:

a. a hook extending from said distal end of said first blade;

b. a straight portion extending toward said handle from a bend of said hook;

c. a fulcrum extending as a smoothed triangular extension from said straight portion;

d. a bottle opener, spaced apart from said fulcrum across a recess for receiving edges of bottle caps to be lifted, and extending to said handle.

* * * * *